US009972919B2

(12) United States Patent
Hong et al.

(10) Patent No.: US 9,972,919 B2
(45) Date of Patent: May 15, 2018

(54) ANTENNA APPARATUS AND ELECTRONIC DEVICE HAVING SAME

(71) Applicant: Samsung Electronics Co., Ltd., Suwon-si, Gyeonggi-do (KR)

(72) Inventors: Won-Bin Hong, Seoul (KR); Kwang-Hyun Baek, Anseong-si (KR); Yoon-Geon Kim, Busan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days. days.

(21) Appl. No.: 14/915,026

(22) PCT Filed: Sep. 3, 2014

(86) PCT No.: PCT/KR2014/008261

§ 371 (c)(1),
(2) Date: Feb. 26, 2016

(87) PCT Pub. No.: WO2015/041422

PCT Pub. Date: Mar. 26, 2013

(65) Prior Publication Data

US 2016/0211586 A1 Jul. 21, 2016

(30) Foreign Application Priority Data

Sep. 23, 2013 (KR) ..... 10-2013-0112353

(51) Int. Cl.
*H01Q 1/24* (2006.01)
*H01Q 1/38* (2006.01)
(Continued)

(52) U.S. Cl.
CPC ..... *H01Q 21/293* (2013.01); *H01Q 1/38* (2013.01); *H01Q 1/521* (2013.01); *H01Q 9/0407* (2013.01); *H01Q 15/0086* (2013.01)

(58) Field of Classification Search
CPC .... H01Q 1/38; H01Q 15/0086; H01Q 21/293; H01Q 9/0407; H01Q 1/24
See application file for complete search history.

(56) References Cited

U.S. PATENT DOCUMENTS 6,456,242 B1 9/2002 Crawford
6,496,155 B1 12/2002 Sievenpiper et al.
(Continued)

FOREIGN PATENT DOCUMENTS

CN 101299903 A 11/2008
EP 1 239 539 A2 9/2002
(Continued)

*Primary Examiner* — Tho G Phan
(74) *Attorney, Agent, or Firm* — Jefferson IP Law, LLP

(57) ABSTRACT

According to embodiments of the present invention, an antenna apparatus and an electronic device having the same are provided with a circuit board comprising a plurality of layers; and a plurality of via-holes formed in the plurality of layers, wherein the plurality of via-holes in one layer are arranged in one direction ("horizontal direction") and the plurality of via-holes respectively line up with a plurality of via-holes in another layer, thereby forming a grid-type radiation member. The antenna apparatus and the electronic device having the same according to the present invention can be realized through various different embodiments.

17 Claims, 15 Drawing Sheets

(51) Int. Cl.

| | |
|---|---|
| ***H01Q 21/29*** | (2006.01) |
| ***H01Q 9/04*** | (2006.01) |
| ***H01Q 15/00*** | (2006.01) |
| ***H01Q 1/52*** | (2006.01) |

(56) References Cited

U.S. PATENT DOCUMENTS

| | | | | |
|---|---|---|---|---|
| 7,015,860 | B2 | 3/2006 | Alsliety | |
| 7,423,601 | B2 * | 9/2008 | Brown | H01Q 3/46 343/700 MS |
| 7,619,491 | B2 * | 11/2009 | Takata | H03H 9/0576 333/133 |
| 7,847,737 | B2 | 12/2010 | Kuroda | |
| 7,911,386 | B1 | 3/2011 | Itoh et al. | |
| 8,723,732 | B2 | 5/2014 | Lee et al. | |
| 9,035,848 | B2 * | 5/2015 | Infante | H01Q 21/00 343/700 MS |
| 9,368,866 | B2 * | 6/2016 | Yu | H01Q 1/526 |
| 2007/0296640 | A1 | 12/2007 | Colburn et al. | |
| 2008/0266026 | A1 | 10/2008 | Han et al. | |
| 2009/0015354 | A1 | 1/2009 | Kim et al. | |
| 2010/0039343 | A1 | 2/2010 | Uno et al. | |
| 2010/0245455 | A1 | 9/2010 | Mizes et al. | |
| 2011/0031007 | A1 | 2/2011 | Kim et al. | |
| 2011/0037678 | A1 * | 2/2011 | Tang | H01Q 1/2266 343/860 |
| 2011/0102289 | A1 | 5/2011 | Leem | |
| 2011/0148738 | A1 | 6/2011 | Sim | |
| 2011/0248890 | A1 | 10/2011 | Lee et al. | |
| 2012/0026043 | A1 | 2/2012 | Rida et al. | |
| 2012/0325544 | A1 | 12/2012 | Toyao et al. | |
| 2013/0207869 | A1 | 8/2013 | Han et al. | |
| 2014/0015723 | A1 * | 1/2014 | Cho | H01Q 13/103 343/750 |
| 2016/0294052 | A1 * | 10/2016 | Baek | H01Q 3/01 |

FOREIGN PATENT DOCUMENTS

| | | | |
|---|---|---|---|
| EP | 1 307 078 | A2 | 5/2003 |
| EP | 1 307 078 | A3 | 1/2004 |
| EP | 2 439 776 | A2 | 4/2012 |
| JP | 2010-28182 | A | 2/2010 |
| JP | 2012-44653 | A | 3/2012 |
| KR | 10-2011-0049544 | A | 5/2011 |
| KR | 10-1119354 | B1 | 3/2012 |
| KR | 10-1151379 | B1 | 6/2012 |

* cited by examiner

ANTENNA APPARATUS AND ELECTRONIC DEVICE HAVING SAME

PRIORITY

This application is a U.S. National Stage application under 35 U.S.C. § 371 of an International application filed on Sep. 3, 2014 and assigned application number PCT/KR2014/008261, which claimed the benefit of a Korean patent application filed on Sep. 23, 2013 in the Korean Intellectual Property Office and assigned Serial number 10-2013-0112353, the entire disclosure of which is hereby incorporated by reference.

TECHNICAL FIELD

Embodiments of the present invention relate to an electronic device and disclose, for example, an antenna apparatus for implementing a wireless communication function and an electronic device including the same.

BACKGROUND ART

Wireless communication technologies have recently been implemented in various manners, such as a wireless Local Area Network (w-LAN) represented by a Wi-Fi technology, Bluetooth, Near Field Communication (NEC), etc., as well as commercialized mobile communication network access. Mobile communication services have evolved from voice call based first-generation mobile communication services into fourth-generation mobile communication networks, thereby making the Internet and multimedia services possible. Next-generation mobile communication services, which will be commercialized in the future, are expected to be provided through an ultra-high frequency band of tens of GHz or more.

Further, with the activation of communication standards, such as a wireless local area network (w-LAN), Bluetooth, etc., electronic devices, for example, mobile communication terminals have been equipped with antenna apparatuses that operate in various different frequency bands. For example, fourth-generation mobile communication services have been operated in a frequency band of 700 MHz, 1.8 GHz, 2.1 GHz, etc., Wi-Fi has been operated in a frequency band of 2.4 GHz and 5 GHz although having a slight difference depending on standards, and Bluetooth has been operated in a frequency band of 2.45 GHz.

In order to provide stable service quality in commercialized wireless communication networks, high gains and a wide range of beam coverage of antenna apparatuses have to be satisfied. Since next-generation mobile communication services will be provided through an ultra-high frequency band of tens of GHz or more, advanced antenna apparatuses that exhibit higher performance than the antenna apparatuses used in the previously commercialized mobile communication services may be required. For example, although a radio signal in a higher frequency band can more rapidly transmit a large amount of information, the radio signal is reflected or interrupted by obstacles due to the straightness thereof and has a short signal arrival distance.

Phased array antennas may be effectively used to raise gains of antenna apparatuses and ensure a wide range of beam coverage. For example, phased array antennas may have a plurality of radiators arranged at a predetermined interval (e.g., half of the wavelength of an operating frequency) and may provide a power supply with a phase difference. Antenna apparatuses for military purposes ensure a wide range of beam coverage by rotating high-gain antennas that form fan beams.

DETAILED DESCRIPTION OF THE INVENTION

Technical Problem

As mentioned above, antenna apparatuses having high gains and ensuring a wide range of beam coverage have been required for next-generation wireless communication services provided in an ultra-high frequency band.

Phased array antennas can ensure high gains and a wide range of beam coverage. As mentioned above, phased array antennas may be constituted by arranging a plurality of radiators at a predetermined interval. Accordingly, conventional phased array antennas require considerable installation space and are not suitable for electronic devices, such as mobile communication terminals that have to ensure portability. Furthermore, it is difficult to ensure antenna apparatuses that can ensure stable transmission/reception performance in an ultra-high frequency band in electronic devices equipped with various antenna apparatuses for Wi-Fi, Bluetooth, near field communication, etc. as well as mobile communication services.

Accordingly, various embodiments of the present disclosure provide an antenna apparatus for ensuring a high gain and amide range of beam coverage and an electronic device including the same.

Further, various embodiments of the present disclosure provide an antenna apparatus that can be easily made compact. For example, embodiments of the present disclosure may provide an antenna apparatus that can be easily mounted in a compact electronic device, such as a mobile communication terminal.

Technical Solution

An antenna apparatus, according to embodiments of the present invention, includes: a circuit board constituted by a plurality of layers; and a plurality of via holes formed in each of the layers, wherein the via holes arranged in one layer in one direction (hereinafter, referred to as a 'horizontal direction') are aligned with the via holes formed in another layer to form a grid type radiating member.

The antenna apparatus may further include via pads provided between the one layer (hereinafter, referred to as a 'first layer') and another layer (hereinafter, referred to as a 'second layer') adjacent thereto, and the via pads may connect the via holes formed in the first layer and the via holes formed in the second layer.

The antenna apparatus may further include a feed line provided on the circuit board, and the feed line may be connected to one of the via holes.

In a certain embodiment, the feed line may be connected to a location spaced a distance of 0.07λ to 0.12λ apart from one end of the arrangement of the via holes in the horizontal direction, where 'λ' denotes the resonant frequency of the radiating member.

In another embodiment, at least one of a feed line and a ground part may be provided to a layer that is located on the surface of the circuit board among the layers.

In the antenna apparatus, according to the embodiments of the present invention, a plurality of radiating members may be disposed on the circuit board.

In the arrangement of the plurality of radiating members on the circuit board, the radiating members may be arranged along an edge of the circuit board.

The radiating members may receive a feed signal with a phase difference from a communication circuit disposed on the circuit board.

In a certain embodiment, the antenna apparatus may further include an artificial magnetic conductor (AMC) element provided between the radiating members.

The AMC element may include a plurality of second via holes formed in each of the layers, and the second via holes arranged in the one layer in a perpendicular direction (hereinafter, referred to as a 'second horizontal direction') to that in which the via holes are arranged may be aligned with the second via holes formed in another layer to form a grid type AMC.

Further, the AMC element may further include second via pads provided between a first layer among the layers and a second layer adjacent to the first layer, and the second via pads may connect the second via holes formed in the first layer and the second via holes formed in the second layer.

In a certain embodiment, the AMC element may further include at least one slot formed in each of the second via pads.

In another embodiment, the AMC element may further include: at leas one slot formed in each of the second via pads; and a line portion provided in the slot.

An electronic device equipped with an antenna apparatus, according to embodiments of the present invention, includes: a housing; at least one circuit board accommodated in the housing and constituted by a plurality of layers; and a plurality of via holes formed in each of the layers, wherein the via holes arranged in one layer in one direction (hereinafter, referred to as a 'horizontal direction') are aligned with the via holes formed in another layer to form a grid type radiating member of the antenna apparatus.

The radiating member may be disposed on an edge of the circuit board so as to be located adjacent to one end portion of the housing.

In a certain embodiment, a plurality of radiating members may be arranged along an edge of the circuit board so as to be located adjacent to one end portion of the housing.

In another embodiment, the electronic device may provide power supply with a phase difference to the radiating members.

The above-described electronic device may include a plurality of circuit boards, and a radiating member provided on a first circuit board among the circuit boards may exchange a radio signal with a radiating member provided on a second circuit board among the circuit boards.

In a certain embodiment, the electronic device may further include a display module mounted on the housing, and the second circuit board may be provided in the display module.

Advantageous Effects

In the antenna apparatus, according to the embodiments of the present invention, the via holes formed in the layers constituting the circuit board are arranged to thrill a grid pattern, thereby implementing the radiating members. A phased array antenna can be constituted by arranging the radiating members along an edge of the circuit board, thereby easily ensuring a mounting space in a compact electronic device. Further, each radiating member can form a horizontal fan beam, and electrical beam steering can be made by providing power supply with a phase difference to the radiating members, thereby ensuring a stable gain and a wide range of beam coverage even during communication in an ultra-high frequency band of tens of GHz or more.

MODE FOR CARRYING OUT THE INVENTION

Hereinafter, various embodiments of the present invention will be described in detail with reference to the accompanying drawings. In the description of the embodiments of the present disclosure, when it is determined that a detailed description of related well-known functions or structures causes confusion in the subject matter of the present disclosure, the description will be omitted. In addition, terms described later are defined in consideration of functions in the embodiment, but they may be replaced with other terms according to intention of a user or an operator, or a practice. Therefore, the terms will be defined more definitely through the description of the various embodiments of the present disclosure. Further, in the description of the embodiments of the present invention, a use of an ordinal number such as first and second is to distinguish objects having identical names from one another, and an order of the objects may be determined arbitrarily.

Figure 1:
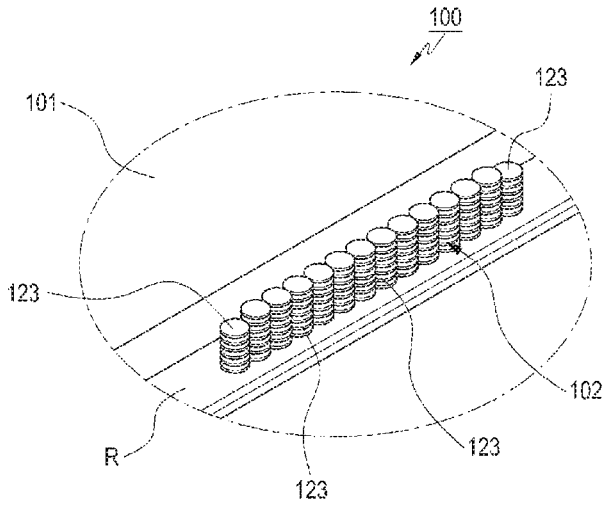
FIG. 1 is a perspective view of an antenna apparatus according to one of the embodiments of the present invention.
Figure 2:
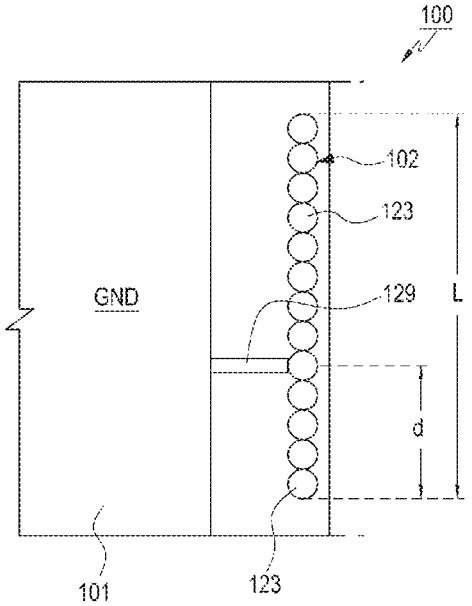
FIG. 2 is a top plan view of the antenna apparatus according to one of the embodiments of the present invention.
Figure 3:
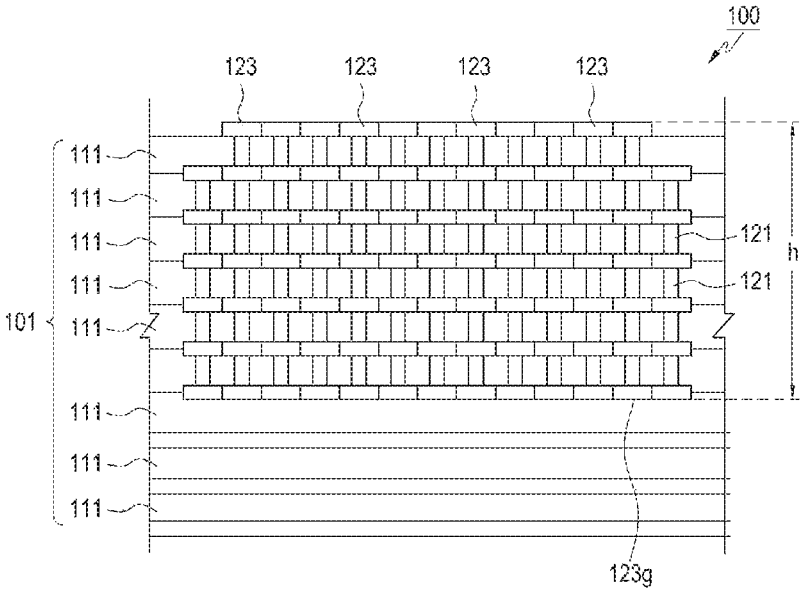
FIG. 3 is a front view of the antenna apparatus according to one of the embodiments of the present invention.

FIG. 1 is a perspective view of an antenna apparatus according to one of the embodiments of the present invention. FIG. 2 is a top plan view of the antenna apparatus according to one of the embodiments of the present invention. FIG. 3 is a front view of the antenna apparatus according to one of the embodiments of the present invention.

Referring to FIGS. 1 to 3, the antenna apparatus 100, according to one of the embodiments of the present invention, may be provided with via holes 121 formed in each layer 111 that constitutes a multilayer circuit board 101, and the via holes 121 may be arranged in a grid pattern to form a patch type radiating member 102. It should be noted that FIGS. 1 to 3 illustrate a part R of the circuit board 101 where the layers 111 around the via holes 121 are partially removed in order to make the configuration of the via holes 121 more clear.

The circuit board 101 has the plurality of layers 111 stacked on each other and may be formed of a flexible printed circuit board, a dielectric board, etc. Each of the layers 111 may have via holes formed through a printed circuit pattern or ground layer, which is formed of a conductor, and the front and rear surfaces thereof (or the upper and lower surfaces thereof). In general, the via holes formed in the multilayer circuit board are formed in order to electrically connect printed circuit patterns formed in different layers, or to dissipate heat. In the antenna apparatus 100, according to the embodiments of the present invention, the via holes 121 may be arranged in a grid type in a part of the circuit board 101 so as to be used as the radiating member 102.

In an embodiment, each layer 111 that constitutes the circuit board 101 may have the plurality of via holes 121 that are arranged in a partial area thereof, for example, in an area adjacent to an edge thereof in one direction (hereinafter, referred to as a 'horizontal direction'). When the circuit board 101 is brought to completion by stacking the layers 101, the via holes 121 formed in one layer (hereinafter, referred to as a 'first layer') among the layers 111 may be aligned with the via holes 121 formed in another layer (hereinafter, referred to as a 'second layer') adjacent to the first layer. The via holes of the first layer and the via holes of the second layer may be arranged in a straight line. Via pads 123 may be disposed between the via holes of the first layer and the via holes of the second layer, respectively, each of which may provide a stable connection between two adjacent via holes disposed in different layers.

The radiating member 102 is formed of the via holes 121 in the circuit board 101 so that the radiating member 102 can be connected to a communication circuit unit or a ground part (GND), which is provided on the circuit board 101, even without a separate connection member, etc. Namely, a feed line 129 and aground line may be connected to the radiating member 102 at the same time that the circuit board 101 is manufactured. It should be noted that in FIG. 2, the circuit board 101 constituted by the plurality of layers 111 is illustrated as being partially removed so that the feed line 129 is illustrated as being connected to the ground part (GND). The feed line 129 may be connected to one of the via holes 121 to provide a feed signal to the communication circuit unit on the circuit board 101. In addition, some of the via holes 121 or the via pads 123 that constitute the radiating member 102, for example, at least one via pad 123*g* may provide aground to the radiating member 102 to suppress the leakage of a feed signal. The feed line 129 or the ground part (GND) may be constituted on the layer 111 that is located on the surface of the circuit board 101.

Figure 4:
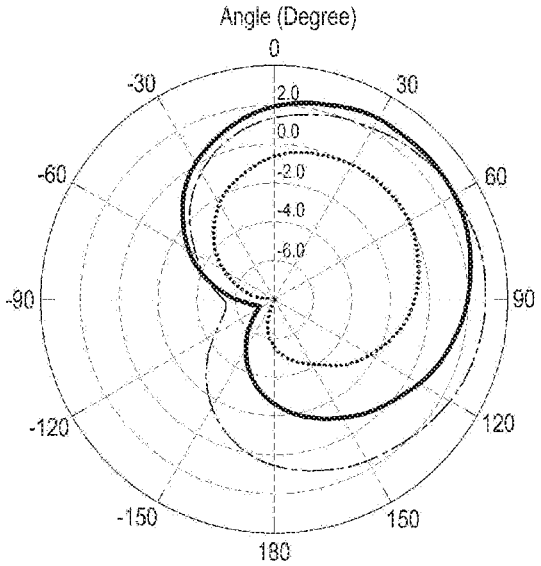
FIG. 4 is a graph illustrating the radiation characteristic of the antenna apparatus according to one of the embodiments of the present invention.

FIG. 4 is a graph illustrating the radiation characteristic of the antenna apparatus according to one of the embodiments of the present invention.

Angles are described along the circumferential direction in the graph illustrated in FIG. 4, where 0 degree refers to the upper side in the direction in which the via holes 121 are stacked, 90 degrees refers to the direction in which the via holes 121 are arranged in one of the layers 111 and the direction perpendicular to the direction in which the via holes 121 are stacked in the circuit board, and 180 degrees refers to the lower side in the direction in which the via holes 121 are stacked. It can be identified that the radiating member 102 forms a horizontal fan beam as illustrated in FIG. 4.

Figure 5:
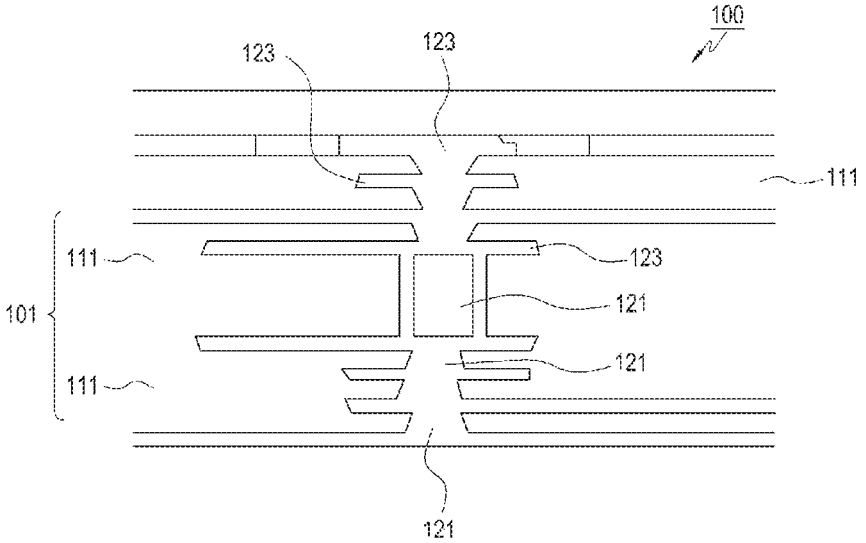
FIG. 5 is a sectional view illustrating an example in which via holes of the antenna apparatus, according to one of the embodiments of the present invention, are arranged.

FIG. 5 is a sectional view illustrating an example in which via holes of the antenna apparatus, according to one of the embodiments of the present invention, are arranged.

A multilayer circuit board may be manufactured by forming via holes in each layer and then stacking the layers having the via holes formed therein, and some via holes formed in different layers may be aligned with each other according to necessity.

As described above, in the antenna apparatus 100, according to the embodiments of the present invention, the via holes 121 formed in the different layers 111 of the circuit board 101 may be aligned with each other to form a grid pattern. The via holes 121 formed in the different layers may not be completely arranged in a straight line according to the locations of the via holes 121 formed in the respective layers ill, or a manufacturing tolerance in the process of stacking the layers 111. Since the via holes 121 are arranged adjacent to each other to form a grid pattern, when the antenna apparatus 100, according to the embodiments of the present invention, transmits and receives a radio frequency signal, the area in which the via holes 121 are arranged may operate as a single conductor, for example, a radiating patch for the radio frequency signal. Accordingly, the via holes 121 do not necessarily have to be arranged in a straight line.

As described above, in the antenna apparatus 100, according to the embodiments of the present invention, the via holes 121 may be arranged in a line in the horizontal direction of the circuit board 101, and the via holes 121 formed in the layers 111 that constitute the circuit board 101 may be arranged to form a grid pattern. Therefore, in the arrangement of the antenna apparatus in an electronic device, it is possible to reduce an area required to install the radiating member and enhance the degree of freedom in the design of the circuit board, such as ensuring a ground area, etc.

Hereinafter, specifications for ensuring the characteristic of the antenna apparatus 100, according to the embodiments of the present invention, will be described in more detail with reference to FIGS. 6 to 8.

Figure 6:
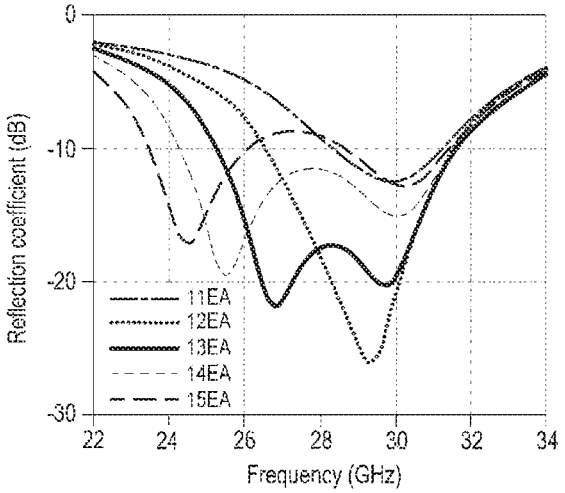
FIG. 6 is a graph illustrating a radiation characteristic depending on the number of via holes that are arranged in the antenna apparatus, according to one of the embodiments of the present invention, in the horizontal direction.

FIG. 6 is a graph illustrating a radiation characteristic depending on the number of via holes that are arranged in the antenna apparatus, according to one of the embodiments of the present invention, in the horizontal direction. FIG. 7 is a graph illustrating a radiation characteristic depending on feeding locations in the antenna apparatus according to one of the embodiments of the present invention. FIG. 8 is a graph illustrating a radiation characteristic depending on the total heights of via holes that are stacked in the antenna apparatus according to one of the embodiments of the present invention.

The antenna apparatus 100, according to the embodiments of the present invention, may implement an operating frequency (or resonant frequency λ) and impedance matching according to the number and length of via holes 121 that are arranged in the horizontal direction and the number and feeding locations of the via holes 121 that are stacked on each other.

In general, the operating frequency of an antenna apparatus, for example, the resonant frequency of a radiator may be set according to the physical and electrical length of the radiator. Further referring to FIG. 2, the radiator of the antenna apparatus 100, according to the embodiments of the present invention, may be constituted by the radiating member 102, and the length L of the radiating member 102 may be the length of the via holes 121 that are arranged in the horizontal direction. In addition, when the resonant frequency λ of the radiating member 102 is determined, the length L of the radiating member 102 is determined by the following Equation 1.

$$L = N \times \frac{\lambda}{4} \quad \text{[Equation 1]}$$

In Equation 1, 'L' denotes the length of the radiating member 102, for example, the length of the via holes 121 that are arranged in the horizontal direction, 'N' is a natural number, and 'λ' denotes the resonant frequency of the radiating member 102. In Equation 1, N may be properly set according to an electronic device to which the antenna apparatus 100 is to be equipped. In an electronic device for mobile communication, the antenna apparatus may be designed to have an electrical length of λ/4.

FIG. 6 illustrates reflection coefficients measured by varying the number of via holes 121 in the range of 11 to 15 in the horizontal direction in order to ensure the communication characteristic in a frequency band of about 28 GHz when constituting the antenna apparatus 100. In this case, the length L of the arrangement of the via holes 121 may be λ/4.

It can be seen that the reflection coefficient and bandwidth vary depending on the number of via holes 121 in the operating frequency band of the antenna apparatus 100, for example, in the band of 28 GHz as illustrated in FIG. 6. In addition, it can be seen that the reflection coefficient of the antenna apparatus can be lowered and the bandwidth can be stabilized in the band of 28 GHz when thirteen via holes are arranged, for example, by a length of λ/4 in the horizontal direction of the circuit board.

The above-configured antenna apparatus is about 30% smaller in size than a fan beam antenna, for example, a room bug lens antenna in the related art so that the antenna apparatus can be easily mounted on the circuit board, and the bandwidth can be improved to 70%.

Figure 7:
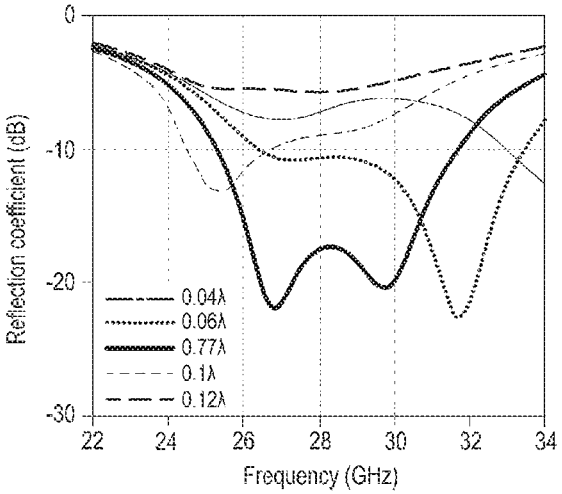
FIG. 7 is a graph illustrating a radiation characteristic depending on feeding locations in the antenna apparatus according to one of the embodiments of the present invention.

FIG. 7 illustrates reflection coefficients depending on feeding locations, for example, the distances (d) of the via holes 121 from one end in the horizontal arrangement in the configuration of the antenna apparatus 100. Further referring to FIG. 2, the reflection coefficient of the radiating member 102 varies depending on the location where the feed line 129 is connected to the radiating member 102, which makes it possible to identify whether the impedance matching of the radiating member 102 has been made.

For example, when the feed line 129 is connected to a feeding location spaced a distance of 0.04λ apart from one end of the radiating member 102 to obtain the resonant frequency of 28 GHz through the radiating member 102, impedance matching may not be ensured. As illustrated in FIG. 7, when the feed line 129 is connected to a feeding location spaced a distance of 0.077λ apart from one end of the radiating member 102, a low reflection coefficient and a sufficient bandwidth can be ensured in the band of 28 GHz. In the band of 28 GHz, the antenna apparatus 100 can ensure a low reflection coefficient and a good bandwidth when the distance (d) from one end of the radiating member 102 to a point where the feed line 129 is connected is in the range of 0.07λ to 0.12λ.

Figure 8:
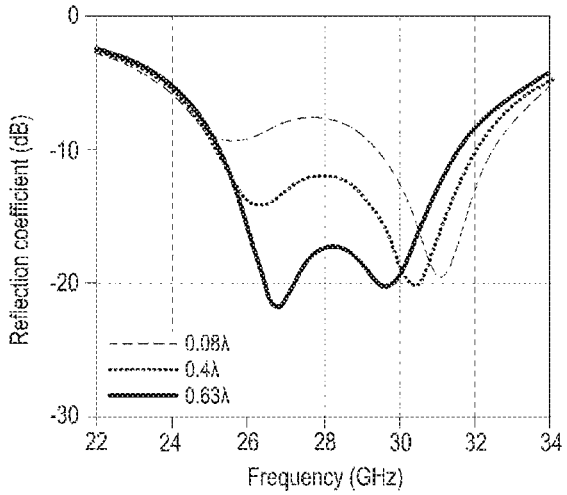
FIG. 8 is a graph illustrating a radiation characteristic depending on the total heights of via holes that are stacked in the antenna apparatus according to one of the embodiments of the present invention.

FIG. 8 illustrates reflection coefficients depending on the total heights (h) of the via holes 121 in the direction in which the layers 111 are stacked on each other. The height of the stacked via holes 121 may vary depending on the number of stacked via holes 121 and the thickness of each layer 111 that constitutes the circuit board 111. For example, one via hole may be implemented at a height of 0.08λ in a circuit board, but nine via holes may be stacked to a height of 0.63λ in another circuit board. When five to ten via holes 121 are stacked to a height of 0.35λ to 0.65λ, a low reflection coefficient and a good bandwidth may be ensured in the band of 28 GHz.

The measurement was carried out in a specific frequency band only to test the performance of the antenna apparatus according to the embodiments of the present invention. However, in the implementation of the antenna apparatus of the present invention, an operating frequency band, the number of via holes, the length by which the via holes are arranged, and the height by which the via holes are stacked are not limited thereto. In other words, the antenna apparatus, according to the embodiments of the present invention, may be implemented as an antenna apparatus that operates in a different frequency band, for example, a commercialized mobile communication frequency band (e.g., 1.8 GHz or 2.1 GHz band) or a 60 GHz frequency band.

Figure 9:
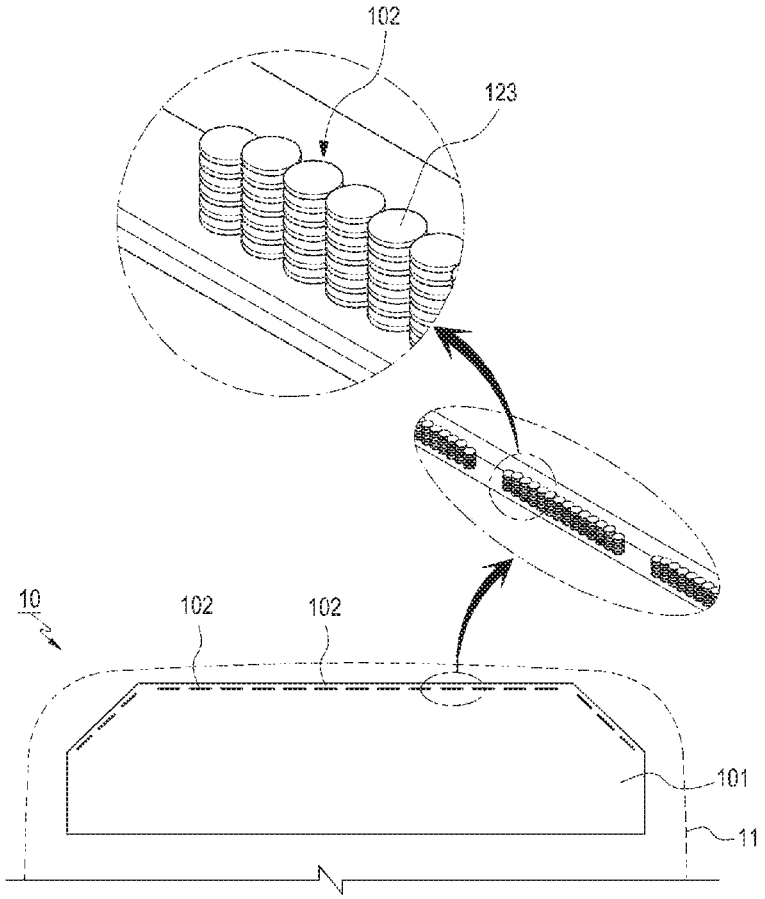
FIG. 9 illustrates an electronic device equipped with the antenna apparatus according to the embodiments of the present invention.

FIG. 9 illustrates an electronic device 10 equipped with the antenna apparatus according to the embodiments of the present invention.

FIG. 9 illustrates a part of the electronic device 10, for example, a mobile communication terminal. The radiating member 102 of the antenna apparatus 100, according to the embodiments of the present invention, may be disposed on an edge of the circuit board 101, and the circuit board 101 may be accommodated in a housing 11 of the electronic device 10 and may be located adjacent to an edge of the housing 11. Further, when viewed from a wire and IC chip mounting area of the circuit board 101, the radiating member 102 of the antenna apparatus, according to the embodiments of the present invention, may be shown as a single line as illustrated in FIG. 9.

In general, when a radiating member is disposed on a circuit board, a fill-cut area is formed to face the radiating member, thereby ensuring radiation efficiency. In other words, in cases where a general antenna apparatus is disposed on a circuit board, the utilization efficiency of the circuit board area is lowered. In addition, the display module and the battery pack of a general electronic device have a characteristic of absorbing and shielding transmission/reception signals of an antenna apparatus. Accordingly, the antenna apparatus is disposed on the upper or lower end, or on opposite lateral ends, of the housing of the electronic device to stably connect with a Wi-Fi network, a commercial communication network, or another user device, thereby minimizing an effect of the display module or the battery pack on the antenna apparatus.

Since the radiating member 102 has the shape of a single line in the wire area of the circuit board 101, it is unnecessary to form a cut-fill area, thereby efficiently utilizing the wire area of the circuit board 101. Further, since the radiating member 102 is mounted within the circuit board 101, it is easy to make the electronic device 10 compact.

A plurality of radiating members 102 may be arranged along an edge of the circuit board 101. When the electronic device 10 is assumed to perform millimeter wave communication, for example, wireless communication in the band of 28 GHz, the radiating members 102 may be arranged at an interval of 0.5λ so as to be adjacent to the upper end of the circuit board 101. The circuit board 101 illustrated in FIG. 9, depending on the shape thereof, may have inclined portions on the opposite sides of the upper end thereof, and the plurality of radiating members 102 may be arranged on the inclined portions of the circuit board 101 as well.

As described above, the radiating members 102 may form a horizontal fan beam. When the antenna apparatus 100 operates while the electronic device 10 is placed in a specific environment, for example, while the electronic device 10 is mounted on a table or a cradle, wireless communication may be effectively performed only with one radiating member 102. In contrast, when the electronic device 10 has to communicate with a base station while moving like a mobile communication terminal, the electronic device 10 may require an antenna apparatus that has an omni-directional radiation characteristic.

The radiating members 102, which are arranged at a predetermined interval in the electronic device 10, may form horizontal fan beams and may receive power supply with a phase difference. As the electronic device 10 provides a power supply with a phase difference, the antenna apparatus constituted by the radiating members 102 may have an omni-directional radiation characteristic. The omni-directional radiation characteristic of the antenna apparatus configured in the electronic device 10 will be described below with reference to FIGS. 10 to 18.

Figure 10:
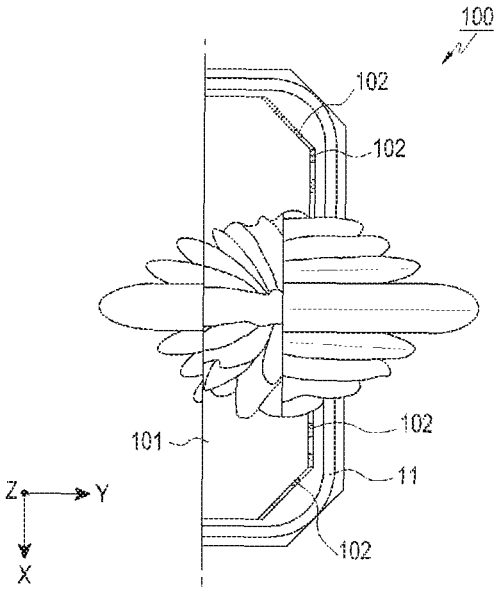
FIG. 10 illustrates a radiation characteristic of the electronic device according to the embodiments of the present invention.
Figure 11:
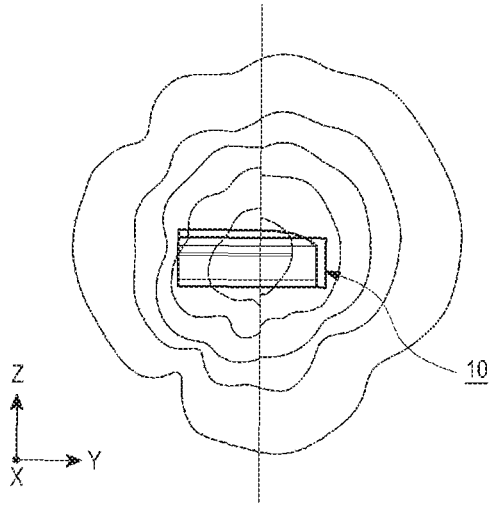
FIG. 11 illustrates the radiation characteristic of the electronic device, according to the embodiments of the present invention, in a different direction.
Figure 12:
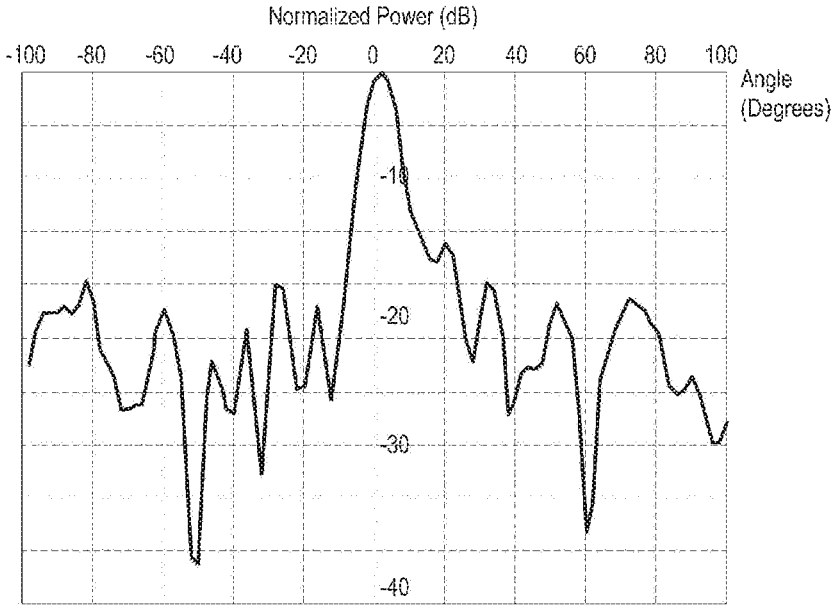
FIG. 12 is a graph illustrating the radiation characteristic of the electronic device according to the embodiments of the present invention.
Figure 13:
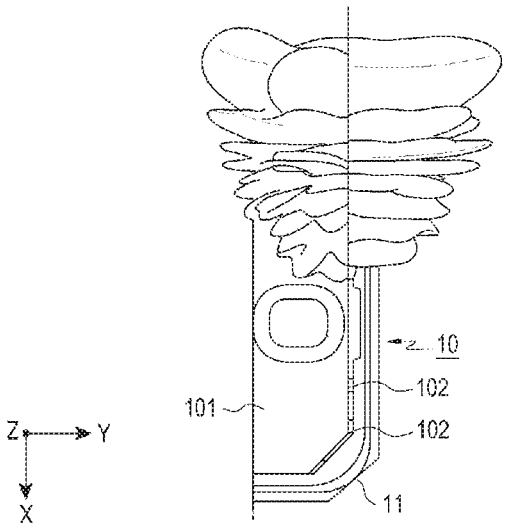
FIG. 13 illustrates a radiation characteristic measured while a power supply with a phase difference is performed for the antenna apparatus of the electronic device according to the embodiments of the present invention.
Figure 14:
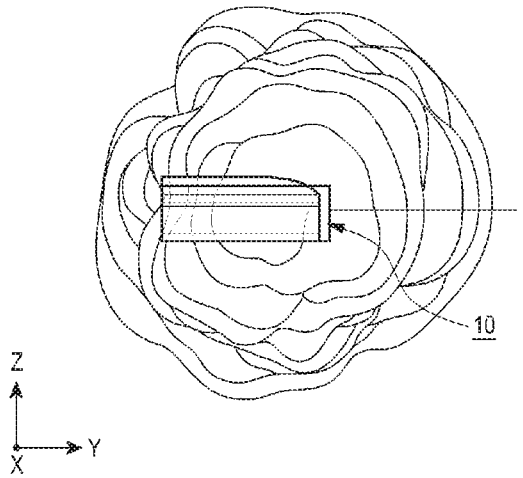
FIG. 14 illustrates the radiation characteristic, which is measured while the power supply with a phase difference is performed for the antenna apparatus of the electronic device according to the embodiments of the present invention, in a different direction.
Figure 15:
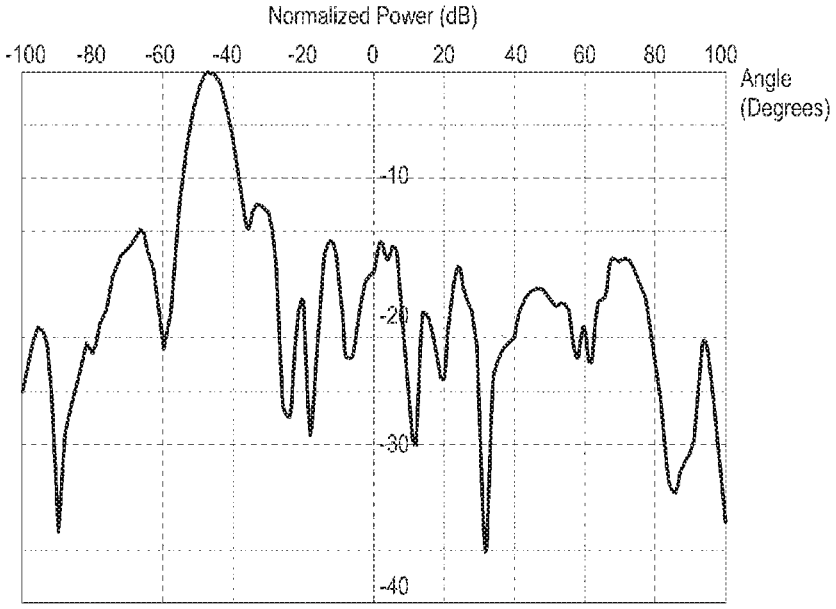
FIG. 15 is a graph illustrating the radiation characteristic measured while a power supply with a phase difference is performed for the antenna apparatus of the electronic device according to the embodiments of the present invention.
Figure 16:
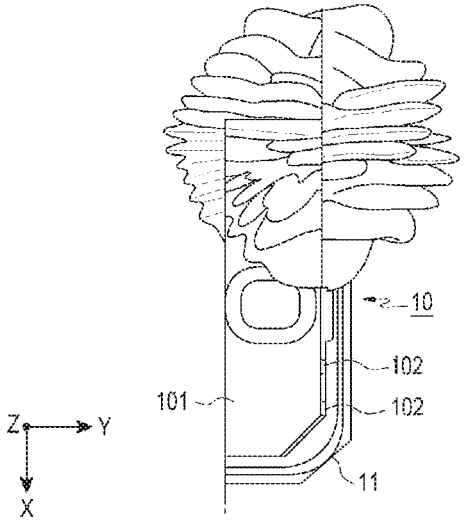
FIG. 16 illustrates a radiation characteristic measured while a different power supply with a phase difference is performed for the antenna apparatus of the electronic device according to the embodiments of the present invention.
Figure 17:
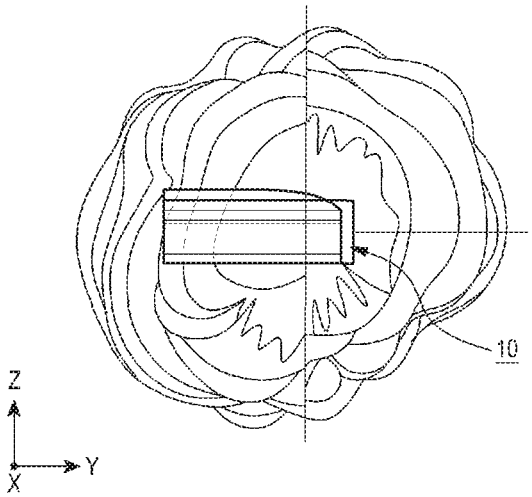
FIG. 17 illustrates the radiation characteristic, which is measured while the different power supply with a phase difference is performed for the antenna apparatus of the electronic device according to the embodiments of the present invention, in a different direction.
Figure 18:
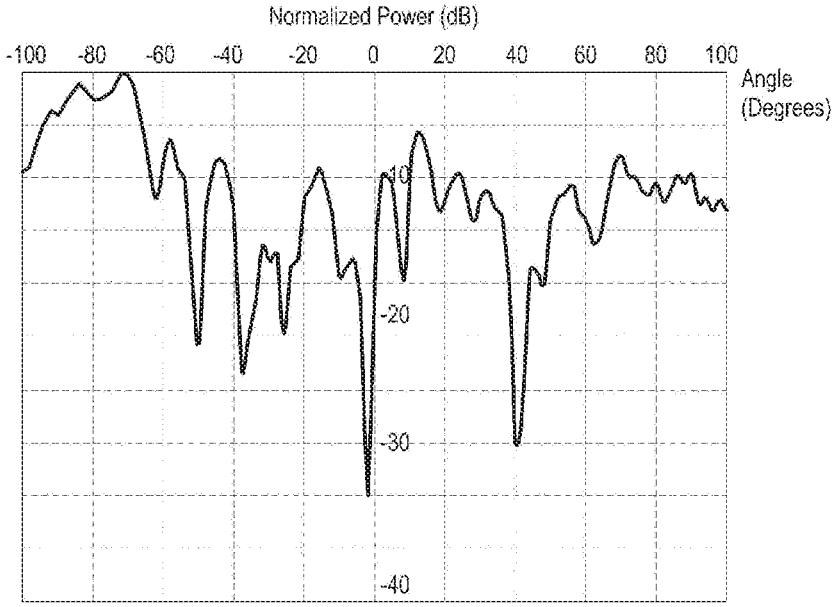
FIG. 18 is a graph illustrating the radiation characteristic measured while a different power supply with a phase difference is performed for the antenna apparatus of the electronic device according to the embodiments of the present invention.

FIG. 10 illustrates a radiation characteristic of the electronic device 10 according to the embodiments of the present invention. FIG. 11 illustrates the radiation characteristic of the electronic device 10, according to the embodiments of the present invention, in a different direction. FIG. 12 is a graph illustrating the radiation characteristic of the electronic device according to the embodiments of the present invention, FIG. 13 illustrates a radiation characteristic measured while a power supply with a phase difference is performed for the antenna apparatus of the electronic device according to the embodiments of the present invention. FIG. 14 illustrates the radiation characteristic, which is measured while the power supply with a phase difference is performed for the antenna apparatus of the electronic device according to the embodiments of the present invention, in a different direction. FIG. 15 is a graph illustrating the radiation characteristic measured while a power supply with a phase difference is performed for the antenna apparatus of the electronic device according to the embodiments of the present invention. FIG. 16 illustrates a radiation characteristic measured while a different power supply with a phase difference is performed for the antenna apparatus of the electronic device according to the embodiments of the present invention. FIG. 17 illustrates the radiation characteristic, which is measured while the different power supply with a phase difference is performed for the antenna apparatus of the electronic device according to the embodiments of the present invention, in a different direction. FIG. 18 is the graph illustrating a radiation characteristic measured while a different power supply with a phase difference is performed for the antenna apparatus of the electronic device according to the embodiments of the present invention.

FIGS. 10 to 12 illustrate a radiation characteristic by the radiating members 102 to which a first signal power (hereinafter, referred to as a 'first phase signal') is applied, FIGS. 13 to 15 illustrate a radiation characteristic by the radiating members 102 to which a second phase signal having a phase difference of 45 degrees with respect to the first phase signal is applied, and FIGS. 16 to 18 illustrate a radiation characteristic by the radiating members 102 to which a third phase signal having a phase difference of 90 degrees (or −45 degrees) with respect to the first phase signal is applied.

It can be seen that horizontal fan beams are formed at different locations according to the phase of the applied signal power, respectively, as illustrated in FIGS. 10 to 18. In other words, electrical beam steering can be made by arranging a plurality of radiating members 102 and providing a power supply with a phase difference. Accordingly, the antenna apparatus, according to the embodiments of the present invention, can ensure an omni-directional radiation characteristic by implementing the beam steering.

Figure 19:
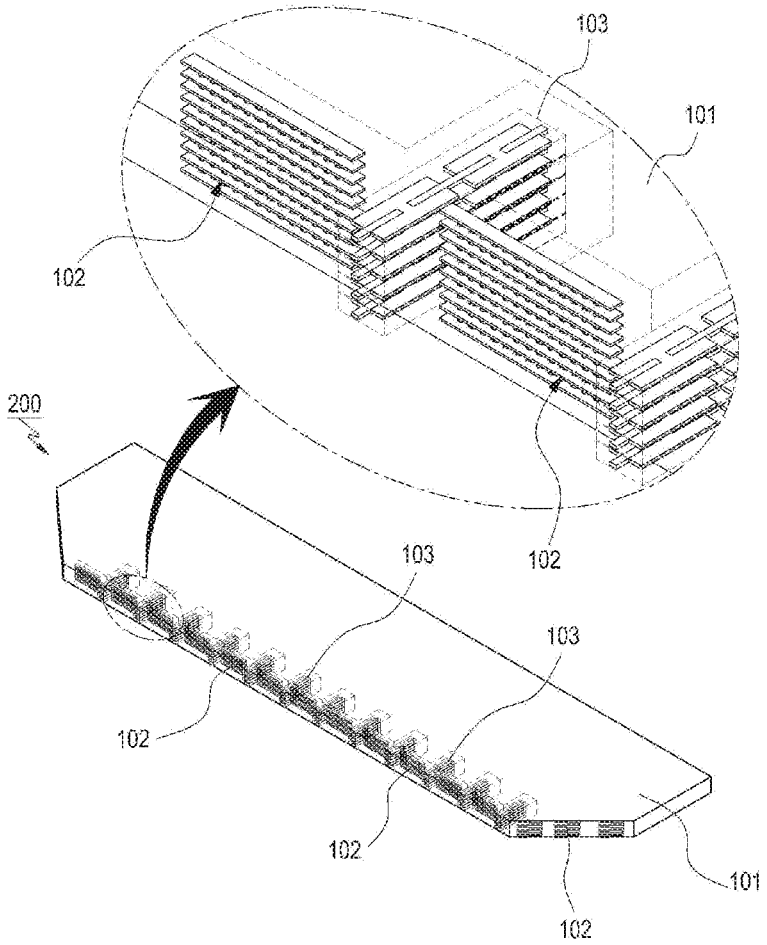
FIG. 19 illustrates an antenna apparatus according to another embodiment among the embodiments of the present invention.
Figure 20:
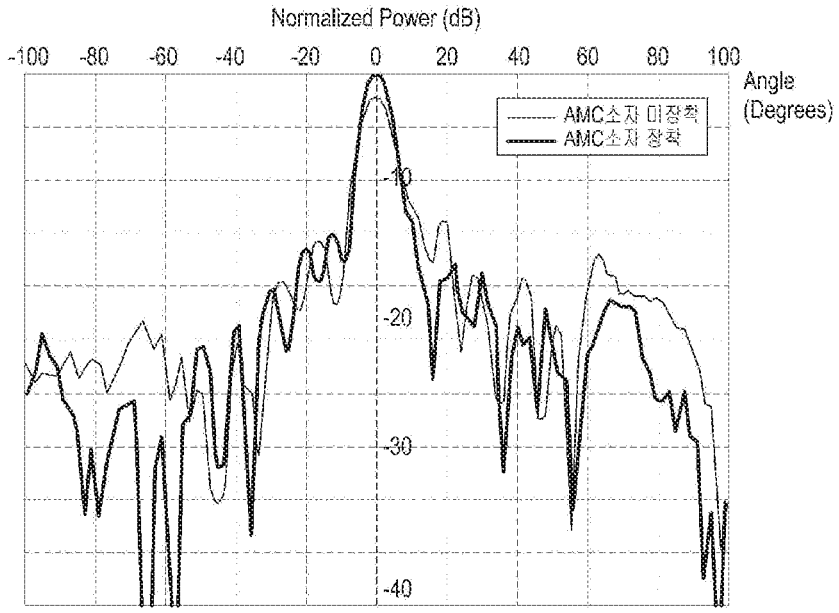
FIG. 20 is a graph illustrating the radiation characteristic of the antenna apparatus according to another embodiment among the embodiments of the present invention.

FIG. 19 illustrates an antenna apparatus according to another embodiment among the embodiments of the present invention. FIG. 20 is a graph illustrating the radiation characteristic of the antenna apparatus according to another embodiment among the embodiments of the present invention.

In the description of the antenna apparatus 200 according to this embodiment, it should be noted that elements that can be easily understood through the antenna apparatus 100 of the preceding embodiments may be provided with identical reference numerals, or reference numerals thereof may be omitted, and detailed descriptions thereof may also be omitted.

In cases where a plurality of radiating members 102 are arranged in a circuit board 101, radiation efficiency may be degraded due to electrical interference between the radiating members 102. Accordingly, in the antenna apparatus 200 constituted by arranging the plurality of radiating members 102 in one circuit board 101, the radiating members 102 need to be electrically isolated from each other.

The antenna apparatus 200, according to one of the embodiments of the present invention, may have isolating members interposed between the radiating members 102 to interrupt electrical interference between the radiating members 102. The isolating members may include Artificial Magnetic Conductor (AMC) elements 103.

When a current flows in one surface of a metal, an image current that flows in the opposite direction is formed on the other surface of the metal, and such an electrical characteristic may serve as a factor that deteriorates radiation efficiency in a radiator of an antenna apparatus. An AMC, namely, an artificial magnetic conductor may form, on the other surface of the metal, an image current that flows in the same direction as that of the current that flows in one surface of the metal. The radiating members 102 may be electrically isolated from each other by disposing such an AMC element.

The AMC elements 103 may be implemented by using via holes formed in the circuit board 101. For example, in one of the layers 111 that constitute the circuit board 101, the AMC element may be implemented by second via holes that are arranged in the perpendicular direction (hereinafter, referred to as a 'second horizontal direction') to that in which via holes 121 constituting the radiating member 102 are arranged. The AMC elements will be described in more detail with reference to FIG. 21, etc.

FIG. 20 is a graph illustrating the radiation power of the antenna apparatus 200 that is measured before and after the isolating members, for example, the AMC elements 103 are disposed, where the antenna apparatus 200 includes the radiating members 102. As illustrated in FIG. 20, the radiation power at the angle for the maximum output can be improved by about 2 dB by electrically isolating the radiating members 102 through the isolating members.

FIGS. 21 to 26 illustrate various examples of implementing the isolating members with AMC elements.

Figure 21:
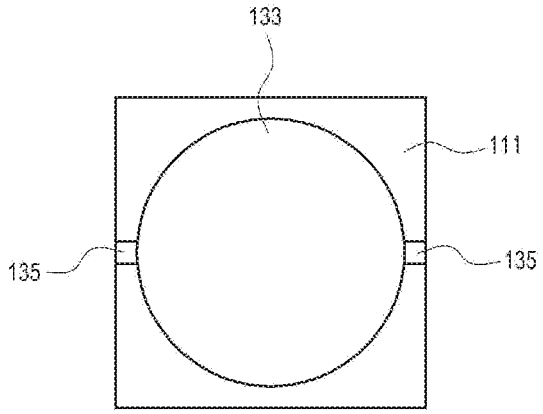
FIG. 21 is a view illustrating the configuration of AMC elements of the antenna apparatus according to another embodiment among the embodiments of the present invention.
Figure 22:
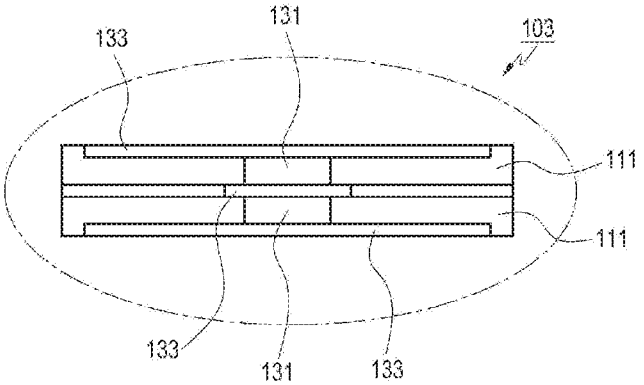
FIG. 22 is a side view illustrating the configuration of the AMC elements of the antenna apparatus according to another embodiment among the embodiments of the present invention.

FIG. 21 is a view illustrating the configuration of AMC elements of the antenna apparatus according to another embodiment among the embodiments of the present invention. FIG. 22 is a side view illustrating the configuration of the AMC elements of the antenna apparatus according to another embodiment among the embodiments of the present invention.

Referring to FIGS. 21 and 22, the AMC element 103 provided as an isolating member may have second via holes 131 formed in the respective layers 111 that constitute the circuit board 101. The second via holes 131 formed in each layer 111 may be arranged in the perpendicular direction (hereinafter, referred to as a 'second horizontal direction') to that in which the via holes 121 constituting the radiating member 102 are arranged. When the circuit board 101 is constituted by combining the layers 111, the second via holes 131 formed in one layer 111 may be aligned with the second via holes 131 formed in another adjacent layer 111 to form a grid pattern. For example, the AMC element 103 may be configured as a grid type AMC.

The AMC element 103 may further include second via pads 133 provided between a first layer among the layers ill and a second layer adjacent to the first layer, and each of the second via pads 133 may connect the via holes 131 formed in the first layer and the second via holes 131 formed in the second layer. The AMC element 103 may constitute a unit cell by using the configuration of the second via pads 133. For example, capacitance may be formed between the second via pads 133 that are disposed in different layers and face each other, and inductance may be formed between the second via pads 133 that are disposed adjacent to each other on one layer. Accordingly, the AMC element can be more easily constituted by disposing the second via pads 133 than when being constituted only by the second via holes 131.

Meanwhile, the AMC element 103 may include a line portion 135 between the second via pads 133 that are disposed adjacent to each other on one layer ill, thereby ensuring inductance. Further, capacitance may be ensured by forming a slot in the second via pads 133.

Figure 23:
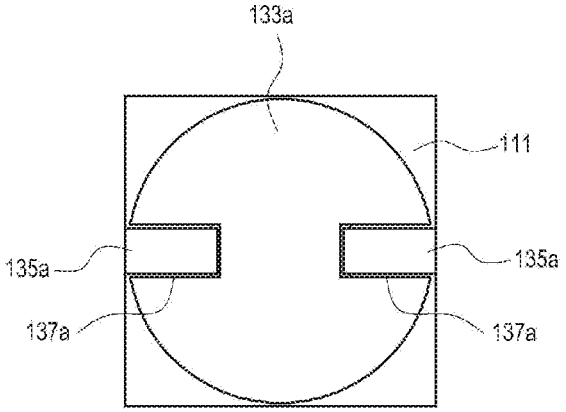
FIG. 23 is a view illustrating a modified example of the AMC elements of the antenna apparatus according to another embodiment among the embodiments of the present invention.
Figure 24:
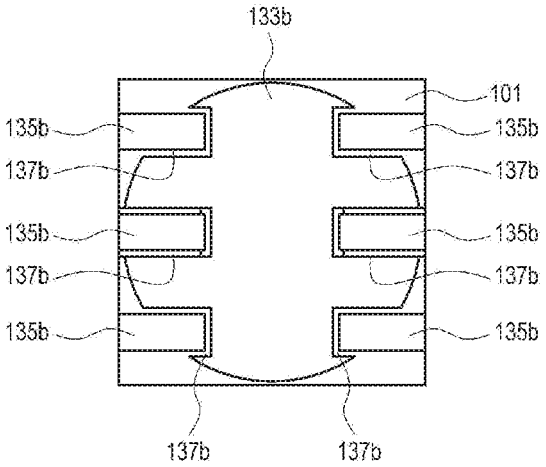
FIG. 24 is a view illustrating another modified example of the AMC elements of the antenna apparatus according to another embodiment among the embodiments of the present invention.

FIG. 23 is a view illustrating a modified example of the AMC elements of the antenna apparatus according to another embodiment among the embodiments of the present invention. FIG. 24 is a view illustrating another modified example of the AMC elements of the antenna apparatus according to another embodiment among the embodiments of the present invention.

As illustrated in FIGS. 23 and 24, the capacitance of the AMC element 103 may be further improved by forming slots 137*a* and 137*b* in second via pads 133*a* and 133*b*, and inductance may be further improved by disposing line portions 135*a* and 135*b*. The slots 137*a* and 137*b* may be formed by removing a part of the conductors that form the second via pads 133*a* and 133*b*. The line portions 135*a* and 135*b* may be disposed between the second via pads 133*a* and 133*b* and other second via pads 133*a* and 133*b* adjacent thereto, and may also be disposed in the slots 137*a* and 137*b* in a certain embodiment. Further, the number and locations of the slots 137*a* and 137*b* may be diversely changed according to the characteristic of the designed AMC element.

In order to ensure the same magnitude of capacitance and inductance, the size of the second via pads 133, 133*a*, and 133*b*, for example, the diameter thereof may be formed to be smaller by disposing the slots 137*a* and 137*b* and the line portions 135, 135*a*, and 135*b*. For example, if the second via pad 133 illustrated in FIG. 21 has a diameter of 1.1 mm, the second via pads 133*a* and 133*b* illustrated in FIGS. 23 and 24 may be formed to have a size of 0.41 mm while having the same capacitance/inductance.

Figure 25:
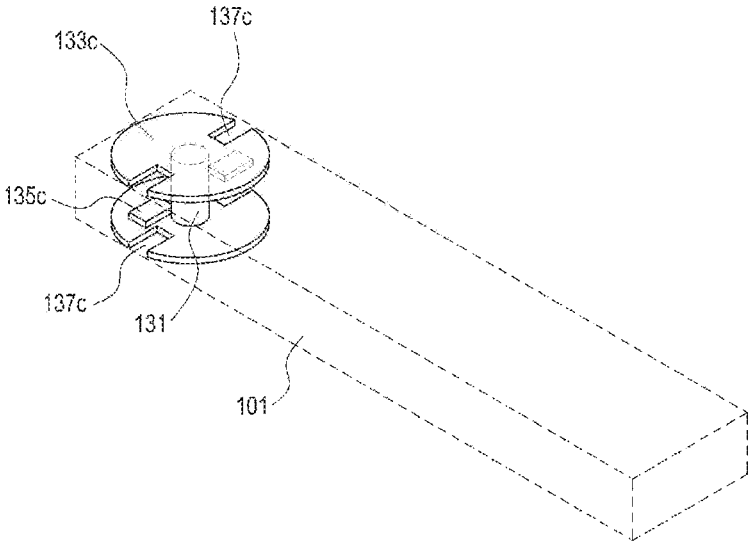
FIG. 25 is a view illustrating the configuration of AMC elements of an antenna apparatus according to yet another embodiment among the embodiments of the present invention.
Figure 26:
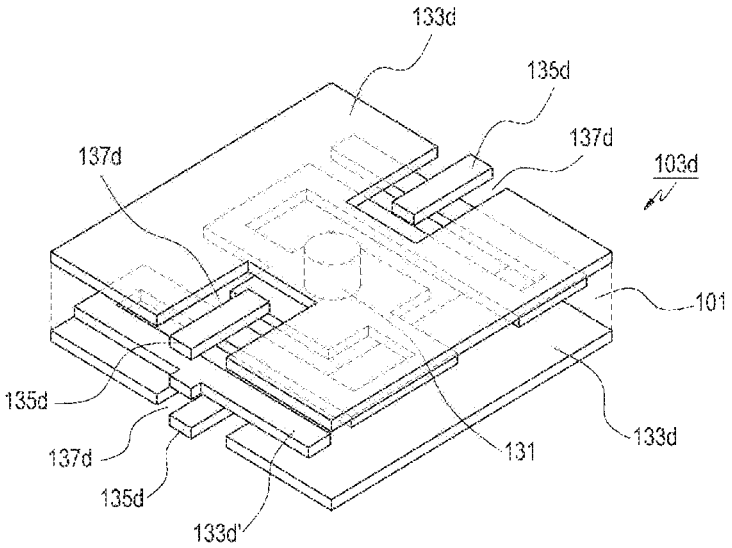
FIG. 26 is a view illustrating the configuration of AMC elements of the antenna apparatus according to yet another embodiment among the embodiments of the present invention.

FIG. 25 is a view illustrating the configuration of AMC elements of an antenna apparatus according to yet another embodiment among the embodiments of the present invention. FIG. 26 is a view illustrating the configuration of AMC elements of an antenna apparatus according to yet another embodiment among the embodiments of the present invention.

FIGS. 25 and 26 are partially enlarged views of the AMC elements of the antenna apparatus according to the embodiment of the present invention, and the AMC element 103 may be implemented by periodically arranging the structures illustrated in FIGS. 25 and 26 on the circuit board 101.

FIG. 25 illustrates a configuration in which second via pads 133*c* are disposed on the upper and lower surfaces of the circuit board 101, respectively, and a pair of line portions 135*c* are disposed between the second via pads 133*c*. Each of the second via pads 133*c* may have slots 137*c* that are formed to correspond to the line portions 135*c*. Although not illustrated, another via pad (hereinafter, referred to as a 'third via pad') is disposed between the second via pads 133*c*. For example, the circuit board 101 may be constituted by at least three layers. The second via pads 133*c* may be disposed on the upper and lower layers, respectively, and the third via pad may be disposed on the intermediate layer. It should be noted that the layers constituting the circuit board 101 are not illustrated for brevity of the drawing. The third via pad may be disposed between the line portions 135*c*.

FIG. 26 illustrates a configuration in which a third via pad 133*d*' is disposed between a pair of second via pads 133*d*. Each of the second via pads 133*d* may have slots 137 formed therein, and line portions 135 may be disposed in the slots 137*d*, respectively. The third via pad 133*d* may have the shape of a meander line. Further, the shape of the third via pad 133*d*' may be designed in various manners without being limited to the meander line.

In the structures illustrated in FIGS. 25 and 26, second via holes may be formed in each layer constituting the circuit board 101, and the second and third via pads may be disposed on one surface of the layer having the second via holes formed therein.

The AMC element 103 may be implemented by stacking or horizontally arranging the structures illustrated in FIGS. 25 and 26 on the circuit board 100, and may be disposed between the radiating members 102 to electrically isolate the radiating member 102. In this case, the second via holes 131 formed in the AMC element 103, when being arranged in a horizontal direction, may be arranged to be perpendicular to the direction in which the via holes 121 of the radiating members 102 are arranged.

The above-described antenna apparatuses, according to the embodiments of the present invention, may be provided in electronic devices so as to be utilized in various frequency bands, such as a connection to a Wi-Fi network or a commercial communication network, short range communication (e.g., Bluetooth, near field communication, etc.), power transmission/reception for wireless charging, and the like. Further, the antenna apparatuses may be utilized in millimeter wave communication in an ultra-high frequency band of tens of GHz or more.

As described above, the antenna apparatuses, according to the embodiments of the present invention, may have a plurality of radiating members arranged on a circuit board and may provide a power supply with a phase difference to implement electrical beam steering, thereby ensuring an omni-directional radiation characteristic in a frequency band of tens of GHz or more. Further, since radiating members are arranged in the shape of a single line in a wire area of a circuit board, the wire area of the circuit board can be efficiently used.

While the present disclosure has been shown and described with reference to certain embodiments thereof, it will be understood by those skilled in the art that various changes in form and details may be made therein without departing from the spirit and scope of the present disclosure as defined by the appended claims.

The invention claimed is:

1. An antenna apparatus comprising:

a circuit board constituted by a plurality of layers;

a plurality of first via holes formed in each of the layers;

a plurality of radiating members disposed on the circuit board; and an isolation element provided between the plurality of radiating members, respectively, the isolation element including a plurality of second via holes being formed in each of the layers, wherein the via holes arranged in a first layer in a first horizontal direction are aligned with the first via holes formed in another layer to form a grid pattern patch type radiating member, and wherein the second via holes are arranged in the first layer in a perpendicular second horizontal direction to that in which the first via holes are arranged.

2. The antenna apparatus of claim 1, further comprising:

via pads provided between the first layer and a second layer adjacent thereto, wherein the via pads connect the first via holes formed in the first layer and the first via holes formed in the second layer.

3. The antenna apparatus of claim 1, further comprising:

a feed line provided on the circuit board, wherein the feed line is connected to one of the first via holes.

4. The antenna apparatus of claim 3, wherein the feed line is connected to a location spaced a distance of 0.07λ to 0.12λ apart from one end of the arrangement of the first via holes in the horizontal direction, and wherein 'λ' denotes the resonant frequency of the radiating member.

5. The antenna apparatus of claim 1, wherein at least one of a feed line or a ground part is provided to a layer that is located on the surface of the circuit board among the layers.

6. The antenna apparatus of claim 1, wherein the radiating members are arranged along an edge of the circuit board.

7. The antenna apparatus of claim 1, wherein the radiating members receive a feed signal with a phase difference, respectively.

8. The antenna apparatus of claim 1, wherein the second via holes formed in one layer are aligned with the second via holes formed in another layer to form a grid type isolation element.

9. The antenna apparatus of claim 8, wherein the isolation element further comprises second via pads provided between a first layer among the layers and a second layer adjacent to the first layer, and the second via pads connect the second via holes formed in the first layer and the second via holes formed in the second layer.

10. The antenna apparatus of claim 9, wherein the isolation element further comprises at least one slot formed in each of the second via pads.

11. The antenna apparatus of claim 9, wherein the isolation element further comprises:

at least one slot formed in each of the second via pads; and a line portion provided in the slot.

12. The antenna apparatus of claim 1, wherein the isolation element includes an artificial magnetic conductor (AMC) element.

13. An electronic device equipped with an antenna apparatus, comprising:

a housing:

at least one circuit board accommodated in the housing and comprised of a plurality of layers;

a plurality of first via holes formed in each of the layers;

a plurality of radiating members disposed on the circuit board; and an isolation element provided between the plurality of radiating members, respectively, the isolation element including a plurality of second via holes being formed in each of the layers, wherein the first via holes arranged in one layer in a horizontal direction are aligned with the first via holes formed in another layer to form a grid pattern patch type radiating member of the antenna apparatus, and wherein the second via holes are arranged in the first layer in a perpendicular second horizontal direction to that in which the first via holes are arranged.

14. The electronic device of claim 13, wherein the radiating member is disposed on an edge of the circuit board so as to be located adjacent to one end portion of the housing.

15. The electronic device of claim 13, wherein the plurality of radiating members are arranged along an edge of the circuit board so as to be located adjacent to one end portion of the housing.

16. The electronic device of claim 15, wherein the electronic device provides power supply with a phase difference to the radiating members.

17. The electronic device of claim 13, wherein the isolation element includes an artificial magnetic conductor (AMC) element.

* * * * *